US011293215B2

(12) United States Patent
Hall

(10) Patent No.: US 11,293,215 B2
(45) Date of Patent: Apr. 5, 2022

(54) DOOR LEAF

(71) Applicant: KINGSWAY ENTERPRISES (UK) LIMITED, Swanley (GB)

(72) Inventor: Benjamin Hall, Swanley (GB)

(73) Assignee: Kingsway Enterprises (UK) Limited, Kent (GB)

( * ) Notice: Subject to any disclaimer, the term of this patent is extended or adjusted under 35 U.S.C. 154(b) by 0 days.

(21) Appl. No.: 16/844,103

(22) Filed: Apr. 9, 2020

(65) Prior Publication Data

US 2021/0025223 A1 Jan. 28, 2021

(30) Foreign Application Priority Data

Jul. 26, 2019 (GB) ..... 1910707

(51) Int. Cl.
*E06B 3/82* (2006.01)
*E06B 3/70* (2006.01)

(52) U.S. Cl.
CPC ..... *E06B 3/82* (2013.01); *E05Y 2900/132* (2013.01); *E06B 2003/7046* (2013.01)

(58) Field of Classification Search
CPC . E06B 3/48; E06B 3/481; E06B 3/485; E06B 3/486; E06B 2003/343; E06B 2003/346; E06B 2003/406; E06B 3/40; E06B 3/82; E06B 2003/7046; E05Y 2900/132
See application file for complete search history.

(56) References Cited

U.S. PATENT DOCUMENTS 4,070,795 A * 1/1978 Lussier ..... E05B 65/102 49/141
4,914,864 A * 4/1990 Hohenfeld ..... E06B 7/32 49/506
6,282,929 B1 * 9/2001 Eller ..... E05C 9/02 70/109

(Continued)

FOREIGN PATENT DOCUMENTS

DE 19809601 A1 9/1999
DE 202019003518 U1 * 10/2019 ..... E06B 3/481

(Continued)

OTHER PUBLICATIONS

Machine translation of foreign reference WO 2015/117177, obtained from https://patentscope.wipo.int/search/en/detail.jsf?docId=WO2015117177&tab=PCTDESCRIPTION&_cid=P22-KM25B9-62594-1#atapta0 (last accessed on Mar. 9, 2021) (Year: 2021).*

(Continued)

*Primary Examiner* — Theodore V Adamos
(74) *Attorney, Agent, or Firm* — Erise IP, P.A.

(57) ABSTRACT

Disclosed in the present application are a door leaf, and a door set comprising the door leaf. The door leaf having a first leaf portion and a second leaf portion. The first and second leaf portions pivotally connected to one another about a pivot axis that extends through one of the first leaf portion and the second leaf portion. The door leaf further comprising a lock configured, when in a locked position, to project across an interface between the two portions to thereby lock the first and second leaf portions so as to be substantially coplanar. The pivot axis is substantially parallel to and spaced from the interface.

20 Claims, 3 Drawing Sheets

(56) References Cited

U.S. PATENT DOCUMENTS

| | | | | |
|---|---|---|---|---|
| 6,745,515 | B1 * | 6/2004 | Chen | E05B 65/10 160/180 |
| 6,823,927 | B2 * | 11/2004 | Steel | E05D 3/022 16/49 |
| 8,533,909 | B2 * | 9/2013 | Minegishi | E05F 1/1215 16/76 |
| 9,631,410 | B2 * | 4/2017 | Nakao | E06B 3/7007 |
| 9,814,327 | B2 * | 11/2017 | Giulietti | E05F 17/004 |
| 2009/0151264 | A1 * | 6/2009 | Boens | E06B 7/36 49/383 |
| 2012/0038257 | A1 * | 2/2012 | Kim | E05B 65/0042 312/405 |
| 2015/0000198 | A1 * | 1/2015 | Takahashi | E05B 65/1026 49/276 |
| 2017/0350185 | A1 * | 12/2017 | Kuan | E05B 65/06 |
| 2018/0273157 | A1 * | 9/2018 | Hoogeveen | E06B 3/482 |
| 2019/0330901 | A1 * | 10/2019 | Shinmura | E05D 7/081 |

FOREIGN PATENT DOCUMENTS

| | | | | |
|---|---|---|---|---|
| DE | 202020101759 | U1 * | 4/2020 | E06B 3/481 |
| JP | H0666069 | A1 | 3/1994 | |
| JP | 2003286786 | A | 10/2003 | |
| JP | 2010270538 | A | 12/2010 | |
| JP | 2013108344 | A | 6/2013 | |
| JP | 2013227825 | A | 11/2013 | |
| WO | WO-2015117177 | A1 * | 8/2015 | E21F 1/10 |
| WO | 2018195719 | A1 | 11/2018 | |

OTHER PUBLICATIONS

Great Britain Patent Application GB1910707.7 Combined Search and Examination Report dated Nov. 28, 2019.

Great Britain Patent Application No. 1910707.7 Examination Report dated May 20, 2020.

* cited by examiner

DOOR LEAF

RELATED APPLICATIONS

This non-provisional patent application claims priority benefit, with regard to all common subject matter of earlier-filed Great Britain Patent Application No. 1910707.7, filed on 26, Jul. 2019 and entitled "DOOR LEAF." The identified earlier-filed patent application is incorporated by reference in its entirety into the present application.

BACKGROUND

1. Field

The present disclosure relates to a door leaf, and in particular to a door leaf for doors in prisons and psychiatric hospitals.

2. Related Art

Conventional door designs are configured to open in one direction (for example inwardly), and to prevent opening in the other direction (for example outwardly). For example, in situations where opening a door outwardly would risk obstructing passers-by in a public corridor, it may be desirable to prevent the door from opening outwardly. To prevent a door comprising a door frame and a door leaf from being opened outwardly, a stop may be provided at an outer side of the door frame, for preventing outward movement of the door leaf.

In some situations, there is a need for doors which can, in exceptional circumstances, open in both directions (inwardly and outwardly). In psychiatric hospitals and prisons, patients/inmates inhabit rooms accessible by a corridor. In normal use, these doors will open inwardly (into the rooms) to prevent obstruction of the corridor. However, on occasion, patients/inmates may barricade the door to their room, thereby preventing the door from being opened inwardly. In such situations, it is important to be able to open the door in the outward direction. There is therefore a demand for door sets that can be opened both inwardly and outwardly in exceptional circumstances.

Various mechanisms exist for allowing doors to be opened both inwardly and outwardly in exceptional circumstances.

One such mechanism is disclosed in patent application GB2509326. A door post is provided between the door frame and the door leaf, and the door leaf is pivotally connected to the door post. A stop is provided to ensure one-directional opening of the door under normal circumstances. The door post is also pivotally connected to the door frame, but a locking rod prevents rotation of the door post relative to the door frame under normal circumstances. In exceptional circumstances, for example when the door has been barricaded, the locking rod is moved to thereby allow rotation of the door post relative to the door frame. This in turn enables the door leaf to move past the stop and thus open in either direction.

A potential drawback of the mechanism disclosed in GB2509326 is that it requires the locking rod and other elements to engage with the door frame in a specific manner. Alteration to the door frame is required to achieve the required engagement. Retrofitting to an existing doorframe is therefore not straightforward.

Another mechanism is disclosed in patent application GB2562483. A door leaf is attached to a door frame by a hinge which comprises a first hinge axis and a second hinge axis, the second hinge axis being offset from the first hinge axis. A stop is provided to ensure one-directional opening of the door under normal circumstances. Rotation about the second hinge axis is prevented, during normal circumstances, by a locking element that extends through the second hinge axis. In exceptional circumstances, for example in which the door has been barricaded, the locking element does not extend through the second hinge axis so as to enable rotation about both the first and second hinge axes. This in turn enables the door leaf to move past the stop and thus open in either direction. The interaction between the second hinge axis and the locking element is mechanically complex.

In the context of psychiatric hospitals and prisons, there also exists a risk that patients may try to cause themselves harm using a ligature created by securing a rope or cable around an available anchor point in a room. There is therefore also a demand for door leaves that minimise or eliminate any such anchor points when fitted to a door frame.

SUMMARY

In a first aspect of the present disclosure there is provided a door leaf. The door leaf has a first leaf portion and a second leaf portion; the first and second leaf portions pivotally connected to one another about a pivot axis that extends through one of the first leaf portion and the second leaf portion; the door leaf further comprising a lock configured, when in a locked position, to project across an interface between the two portions to thereby lock the first and second leaf portions so as to be substantially coplanar; wherein the pivot axis is substantially parallel to and spaced from the interface. A first edge of the door leaf extends along the first leaf portion. A second edge of the door leaf extends along the second leaf portion.

Herein, the pivot axis is defined as an axis about which the first and second leaf portions rotate relative to one another (when the lock is not in the locked position). The pivot axis may be defined by a spindle that passes only part of the way into the door leaf.

A distance that the lock extends into the one of the first leaf portion and second leaf portion, when in the locked position, is less than the distance by which the pivot axis is spaced from the interface. Therefore, even with the lock in the locked position, the lock does not extend to the pivot axis. The lock is thus always spaced from the pivot axis.

The door leaf of the first aspect does not require any special interaction with a door frame to operate. Therefore, the door leaf of the first aspect can be quickly and easily retrofitted to existing door frames. Furthermore, because the lock is laterally offset from the pivot axis, it does not have to pass through any axle or spindle arrangement. In other words, the pivot axis and the lock are independent of one another. Therefore, the door leaf is mechanically simple and robust. Additionally, because the lock projects across the interface, rather than across the pivot axis, predominantly shear forces act on the lock (as opposed to predominantly torsional forces).

Optional features described below further help the door leaf to be mechanically simple and robust. Optional features described below also help to eliminate potential anchor points to which a ligature could otherwise be secured.

The first edge may be substantially the same length as the second edge. A top edge of the door leaf may be substantially perpendicular with the first and second edges. A bottom edge of the door leaf may be substantially perpendicular with the first and second edges. For example, the door leaf may be rectangular.

The lock may be configured, when in the locked position, to project across the interface and to extend into both the first and second leaf portions. For example, the lock may extend from the first leaf portion, across the interface, and into the second leaf portion (for example into a socket in the second leaf portion), when in the locked position.

The lock may be operable to move between the locked position, and an unlocked position in which the lock is retracted into one of the first leaf portion and the second leaf portion. Thus, when the lock is in the unlocked position, the first and second leaf portions are rotatable relative to one another (in particular, rotatable so as to not be substantially coplanar). Or, to phrase it another way, when the lock is in the unlocked position, the first and second leaf portions can rotate independently of each other. The lock is spaced from the pivot axis when in the locked position. It may also be spaced from the pivot axis when in the unlocked position. The lock may be operable using a key.

The lock may comprise a deadbolt for projecting across the interface in the locked position, or may comprise a hook for projecting across the interface in the locked position.

In some examples, the door leaf may comprise first and second locks. In other words, the door leaf may comprise a first lock and a second lock, each of the first lock and the second lock configured, when in the locked position, to project across the interface to thereby lock the first and second leaf portions so as to be substantially coplanar. For example, the first and second locks may each be configured, when in the locked position, to project across the interface and to extend into both the first and second leaf portions. The first and second locks may each be retracted into one of the first leaf portion and the second leaf portion when in the unlocked position. The first lock may comprise a deadbolt. The second lock may comprise a hook.

In examples where the lock comprises a deadbolt, the deadbolt may be received in a socket in the second leaf portion when in the locked position; and may be retracted into the first leaf portion when in the unlocked position. In examples where the lock comprises a hook, the hook may engage a catch in the second leaf portion when in the locked position; and may be retracted into the first leaf portion when in the unlocked position. The deadbolt may move linearly between the locked and unlocked positions. The hook may rotate between the locked and unlocked positions.

In examples where the lock is retracted into the first leaf portion when in the unlocked position, the pivot axis may extend through the second leaf portion. And a locking mechanism of the lock may be contained within the first leaf portion.

The door leaf may further comprise a pivot plate at each end of the pivot axis, each pivot plate being connected to the first leaf portion and comprising a spindle that extends into the second leaf portion along the pivot axis. Each pivot plate may be substantially flush with a respective edge of the door leaf, for example substantially flush with each of the top edge of the door leaf and the bottom edge of the door leaf.

The door leaf may further comprise a hinge along the first edge of the door leaf and connected to the first leaf portion, the hinge being for attachment to a door frame. The hinge may comprise a hinge axis substantially parallel with the interface and the pivot axis. The hinge may be substantially the same length as the first edge of the door leaf. A first end of the hinge may be substantially flush with the first leaf portion. For example, a top end of the hinge may be substantially flush with the top edge of the door leaf. A second end of the hinge may also be substantially flush with the first leaf portion. For example, a bottom end of the hinge may be substantially flush with the bottom edge of the door leaf.

The second leaf portion may be at least double the width of the first leaf portion. That is to say, the second leaf portion may be at least double the width of the first leaf portion in a direction perpendicular to the interface. Thus, the interface may be closer to the first edge of the door frame than to the second edge of the door frame. The first leaf portion may abut the second leaf portion in the coplanar arrangement. The first leaf portion may be flush with the second leaf portion in the coplanar arrangement.

Further, the first leaf portion may maintain abutment with the second leaf portion when rotated relative to the second leaf portion. This may be achieved by a scalloped interaction between the first and second leaf portions along the interface.

In a second aspect there is provided a door set comprising a door frame and the door leaf according to the first aspect. The hinge of the first aspect may be attached to the door frame.

BRIEF DESCRIPTION OF THE DRAWINGS

Examples of the present disclosure will now be described, by way of example only, with reference to the accompanying figures, in which.

DETAILED DESCRIPTION

Figure 1:
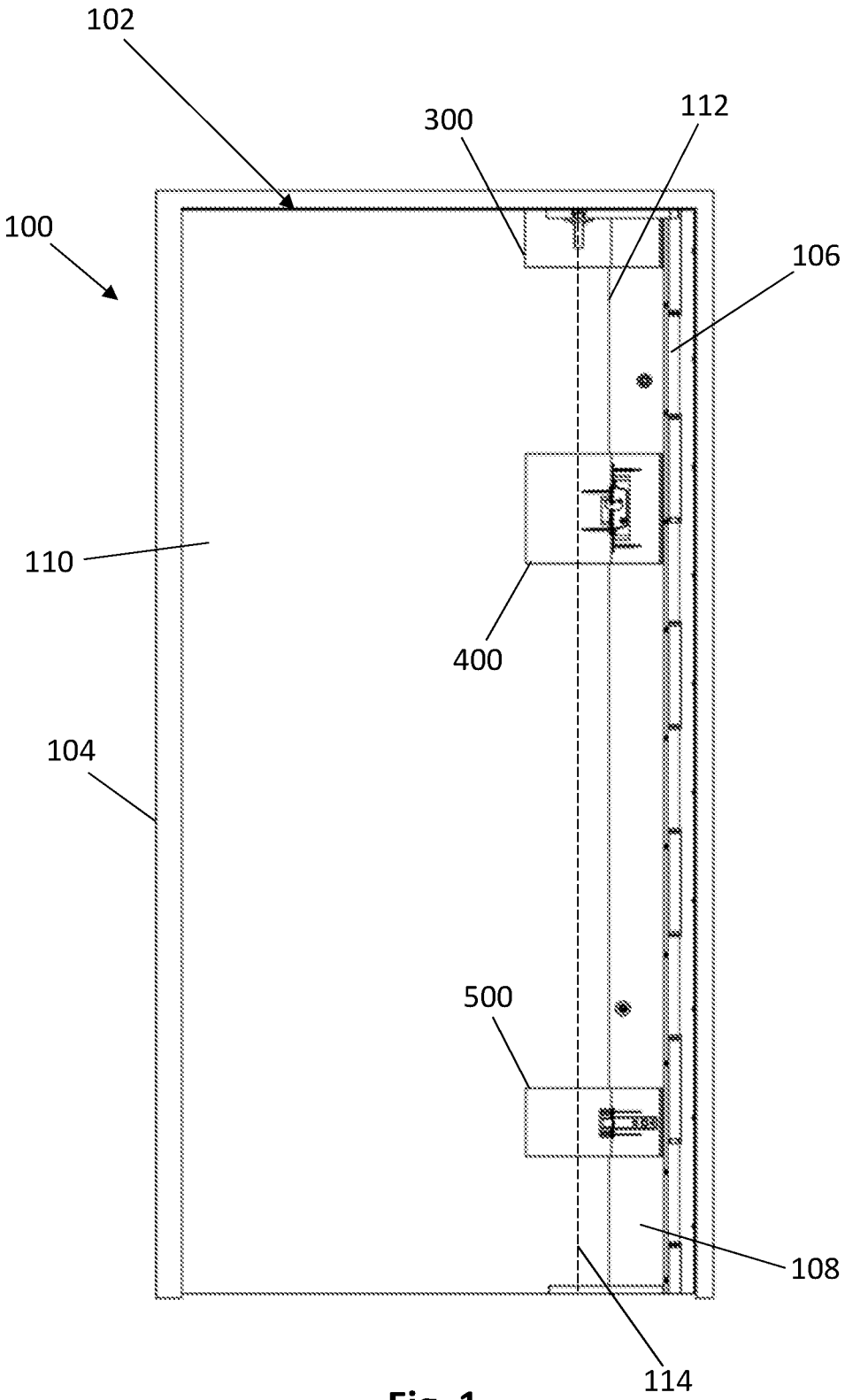
FIG. 1 shows a door set comprising a door leaf and a door frame.

FIG. 1 shows a door set 100 comprising a door leaf 102 and a door frame 104. Door leaf 102 is attached to the door frame 104 by a hinge 106. Hinge 106 is a two-way hinge, for allowing movement of the door leaf in both the inward direction and the outward direction.

Door leaf 102 is split into a first leaf portion 108 and a second leaf portion 110 along interface 112. First portion 108 is pivotally connected to second leaf portion 110 about pivot axis 114. The pivot axis 114 is provided by pivot arrangement 300. Pivot arrangement 300 is described in more detail below, with reference to FIG. 2. Pivot axis 114 extends through the second leaf portion 110 and is spaced from the interface 112.

Two locks 400, 500 are provided in the door leaf 102. The structure and operation of the first lock 400 is described in more detail below, with reference to FIG. 3. The structure and operation of the second lock 500 is also described in more detail below, with reference to FIG. 4. When in locked positions, the first and second locks 400, 500 prevent rotation of the first leaf portion 108 relative to the second leaf portion 110 about pivot axis 114; and maintain the two leaf portions in a coplanar arrangement as shown in FIG. 5*a*. When in unlocked positions, the first and second locks 400, 500 do not prevent rotation of the first leaf portion 108 relative to the second leaf portion 110 about pivot axis 114.

With at least one of the locks in the locked position, the first and second leaf portions 108, 110 are maintained in a coplanar arrangement, and the door set can only be opened in a single direction (for example in an inwards direction). With the lock mechanisms in the unlocked position, the first and second leaf portions 108, 110 are rotatable relative to one another, and the door can be opened both inwardly, and outwardly. This is explained in more detail below, with reference to FIGS. 5*a*-5*c*.

Figure 2:
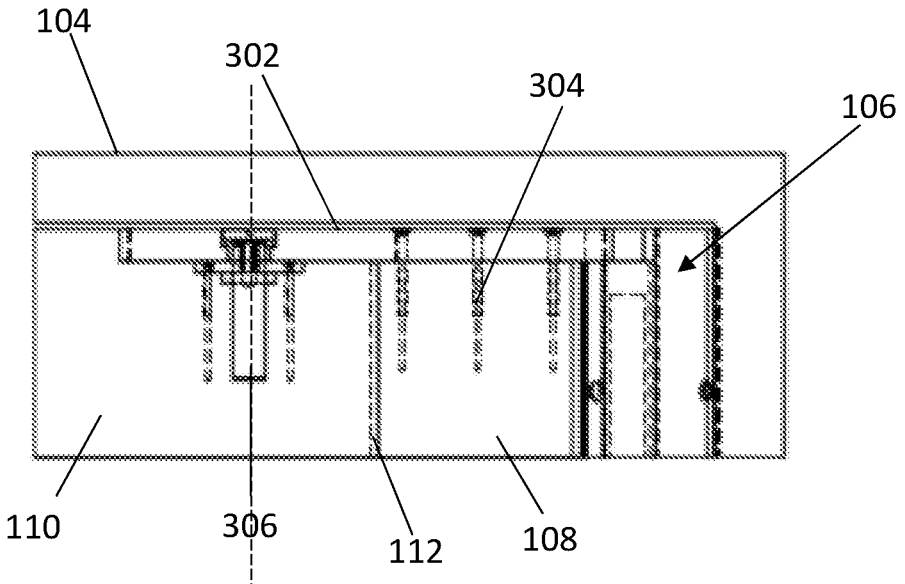
FIG. 2 shows a pivot arrangement of the door leaf of FIG. 1.

FIG. 2 shows the pivot arrangement 300 at the top of the door leaf of FIG. 1. As the skilled person will appreciate, a similar (or mirror image) pivot arrangement 300 may be provided at the bottom of the door leaf. Only the top pivot arrangement is described here, for brevity.

Pivot arrangement comprises a plate 302. Plate 302 attaches to the first leaf portion 108 by screws 304. Screws 304 extend into the first leaf portion 108, to prevent rotation of the plate 302 relative to the first leaf portion 108. Plate 302 sits flush with the top of the hinge 106 and flush with the top of the second leaf portion 110.

Spindle 306 extends from the plate 302 and into the top of the second leaf portion 110 along pivot axis 114. Spindle 306 is rotatably mounted to the plate 302 by a bearing or bushing (not shown). The first leaf portion 108 and the second leaf portion 110 thus rotate relative to one another about the pivot axis 114. Because the spindle 306 extends into the second leaf portion 110, the pivot axis 114 is offset from the interface 112.

Figure 3:
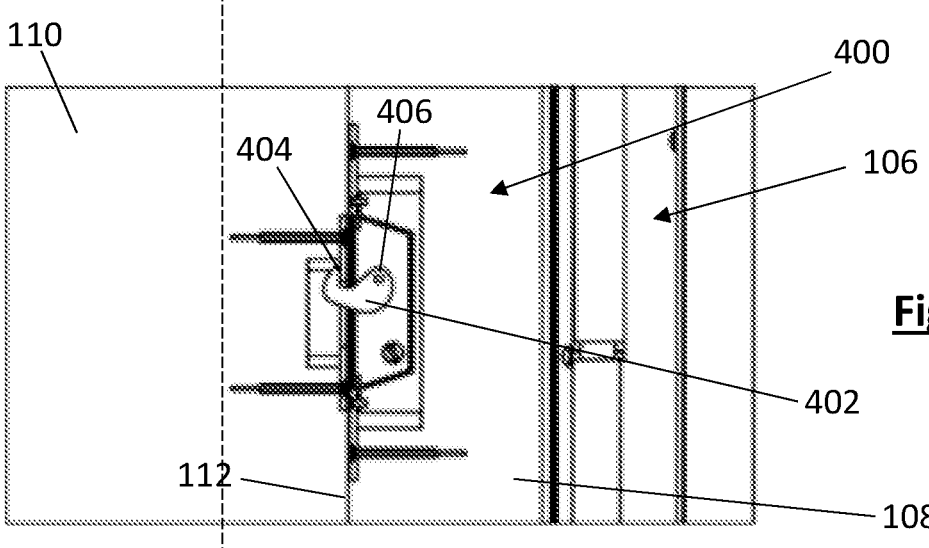
FIG. 3 shows a first locking mechanism of the door leaf of FIG. 1.

FIG. 3 shows the first lock 400 from FIG. 1. The first lock 400 is shown in a locked state in FIG. 3. First lock 400 is housed within first leaf portion 108. In the locked position, first locking element (hook) 402 of the first lock mechanism 400 is rotated so as to extend from the lock mechanism 400 in the first leaf portion 108; across interface 112; and into the second leaf portion 110, where it engages with a catch 404 in the second leaf portion 110. Thus, the first locking element (hook) 402 prevents rotation of the first leaf portion relative to the second leaf portion.

When the first lock 400 is moved into an unlocked state (not shown), the first locking element (hook) 402 rotates downwards, about axis 406, so as to retract into the first leaf portion 108. In the unlocked position, the first locking element 402 is completely housed within the first leaf portion 108. It does not extend across the interface 112. Thus, locking element 402 does not act to impede rotation of the first leaf portion 108 relative to the second leaf portion 110 when in the unlocked position.

The first locking element 402 is moved between the locked position and the unlocked position by a key inserted into the first lock 400.

Figure 4:
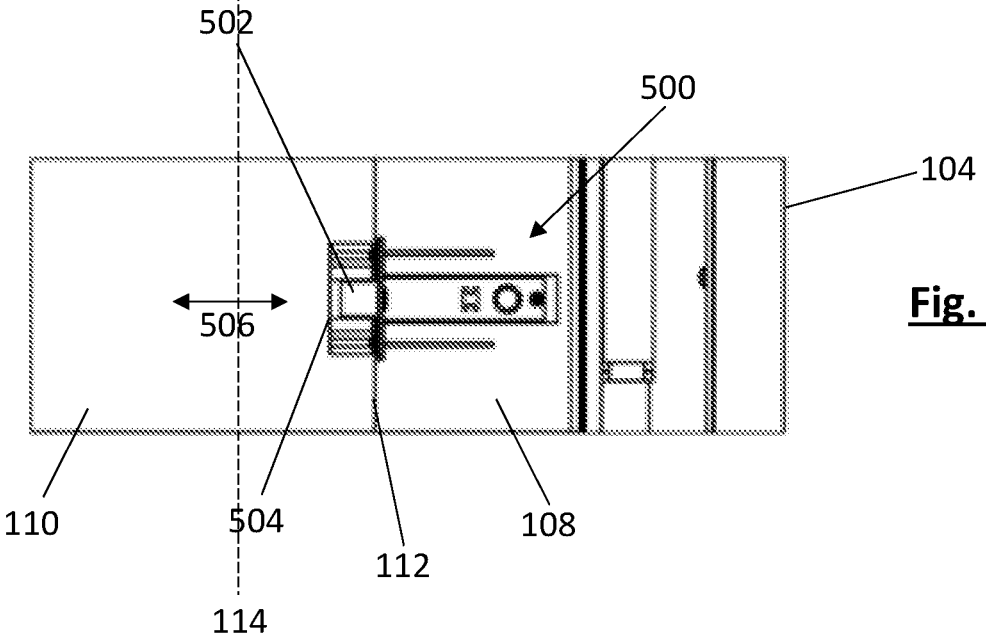
FIG. 4 shows a second locking mechanism of the door leaf of FIG. 1.
Figure 5A:
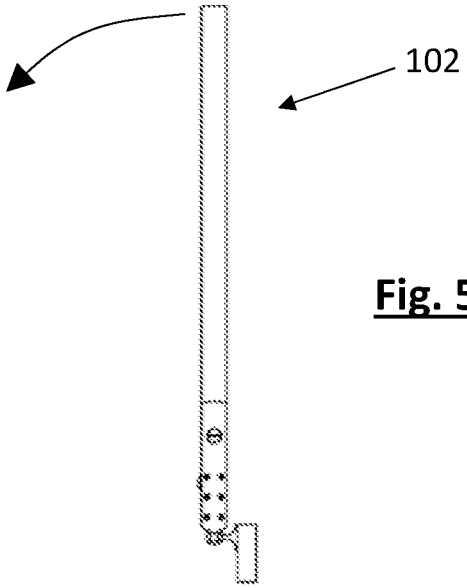
FIGS. 5*a*-5*c* illustrate operation of the door of FIG. 1, as viewed from above.

FIG. 4 shows the second lock 500 from FIG. 1. The second lock 500 is shown in a locked state in FIG. 5. Second lock 500 is housed within first leaf portion 108. In the locked position, second locking element (deadbolt) 502 of the second lock 500 is rotated so as to extend from the second lock 500 in the first leaf portion 108; across interface 112; and into the second leaf portion 110, where it engages with a socket 504 in the second leaf portion 110. Thus, the second locking element (deadbolt) 502 prevents rotation of the first leaf portion relative to the second leaf portion.

When the second lock 500 is moved into an unlocked state (not shown), the second locking element (deadbolt) 502 moves in a linear motion, in direction 506, so as to retract into the first leaf portion 108. In the unlocked position, the second locking element 502 is completely housed within the first leaf portion 108. It does not extend across the interface 112. Thus, second locking element 502 does not act to impede rotation of the first leaf portion 108 relative to the second leaf portion 110 when in the unlocked position.

The second locking element 502 is moved between the locked position and the unlocked position by a key inserted into the second lock 500, or by an electrically driven solenoid device installed within the second lock 500.

First and second locks 400, 500 are laterally offset from the pivot axis 114.

Figure 5B:
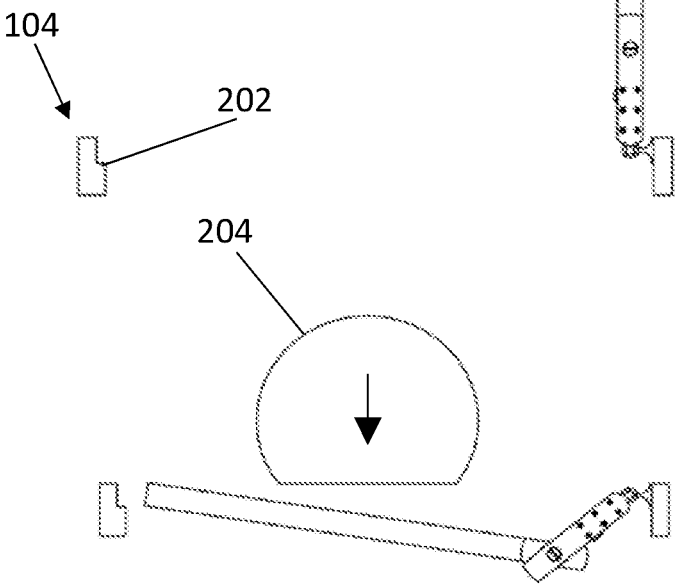
Figure 5C:
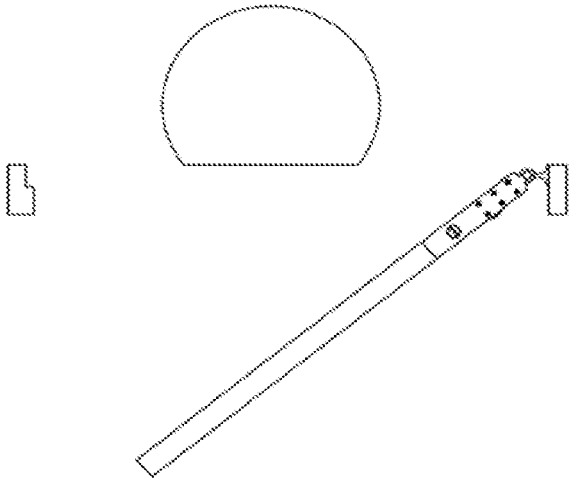

FIGS. 5*a*-5*c* illustrate operation of the door 100 of FIG. 1, as viewed from above. FIG. 5*a* shows the door 100 in an inwardly opened position. The door leaf 102 is locked in the coplanar arrangement (in which the first leaf portion 108 and the second leaf portion 110 are coplanar with each other). When the door is closed, as illustrated with arrow 200 in FIG. 5*a*, the door leaf 102 comes into abutment with stop 202 of the door frame 104. The stop 202 is positioned to prevent the door from being opened outwardly.

If the door becomes barricaded by an object 204, inward opening of the door is also prevented. Inward opening of the door is prevented by the barricade 204, and outward opening of the door is prevented by the stop 202. With a normal door frame, this would prevent the door from being opened entirely.

However, as shown in FIG. 5*b*, by unlocking the door leaf 102 such that the first portion 108 can rotate relative to the second portion 110, the second edge of the door frame (the edge opposite the hinge) is retracted away from the stop 202 such that the door leaf 102 can move past the stop 202. Opening of the door 100 becomes possible in the outwards direction. Therefore, even when the door is barricaded from the inside, it is still possible to open the door from the outside by unlocking the locks 400, 500.

As shown in FIG. 5*c*, once the door has been opened, the door leaf 102 can be returned to the (co-)planar arrangement and re-locked, ready to resume normal use.

As shown in FIGS. 5*a*-5*c*, the first leaf portion 108 and second leaf portion 110 are scalloped. This ensures that they maintain contact with each other as they rotate relative to each other. No gaps exist between the two leaf portions.

It is to be understood that the above description is intended to be illustrative, and not restrictive. Many other implementations will be apparent to those of skill in the art upon reading and understanding the above description. Although the present disclosure has been described with reference to a specific example implementation, it will be recognized that the disclosure is not limited to the implementations described, but can be practiced with modification and alteration insofar as such modification(s) and alteration (s) remain within the scope of the appended claims. Accordingly, the specification and drawings are to be regarded in an illustrative sense rather than a restrictive sense. The scope of the disclosure should, therefore, be determined with reference to the appended claims, along with the full scope of equivalents to which such claims are entitled.

The invention claimed is:

1. A door leaf, the door leaf split into a first leaf and a second leaf along an interface;

the first leaf connected to the second leaf pivotally about a pivot axis that extends through one of the first leaf and the second leaf; and the door leaf further comprising a lock configured, when in a locked position, to project across the interface to thereby lock the first leaf and the second leaf into a substantially coplanar arrangement, wherein the pivot axis is substantially parallel to and spaced from the interface, wherein the pivot axis and the interface are each positioned closer to a first edge of the door leaf than to a second opposite edge of the door leaf, wherein the first leaf and the second leaf are arranged side-by-side, and wherein the entire interface defines a straight line.

2. The door leaf of claim 1, wherein the lock is configured, when in the locked position, to extend into both the first leaf and the second leaf.

3. The door leaf of claim 1, wherein the pivot axis extends through the second leaf.

4. The door leaf of claim 1, wherein the lock is operable to move between the locked position and an unlocked position in which the lock is retracted into one of the first leaf and the second leaf.

5. The door leaf of claim 4, wherein the first leaf is rotatable relative to the second leaf about the pivot axis when the lock is in the unlocked position, and the first leaf is locked against rotation relative to the second leaf when the lock is in the locked position.

6. The door leaf of claim 4, wherein the lock is retracted into the first leaf when in the unlocked position.

7. The door leaf of claim 1, wherein the lock comprises a deadbolt projecting across the interface in the locked position.

8. The door leaf of claim 1, wherein the lock comprises a hook projecting across the interface in the locked position.

9. The door leaf of claim 1, wherein the lock is a first lock and further comprising a second lock, each of the first lock and the second lock configured, when in the locked position, to project across the interface to thereby lock the first leaf and the second leaf in a substantially coplanar arrangement.

10. The door leaf of claim 9, wherein the first lock is a deadbolt, and the second lock is a hook.

11. The door leaf of claim 1, further comprising a hinge along the first edge of the door leaf and connected to the first leaf, the hinge configured to be attached to a door frame.

12. The door leaf of claim 11, wherein the hinge comprises a hinge axis substantially parallel with the interface.

13. The door leaf of claim 11, further comprising a first pivot plate at a first end of the pivot axis and a second pivot plate at a second end of the pivot axis opposite the first end of the pivot axis, each of the first pivot plate and the second pivot plate being connected to the first leaf and comprising a spindle that extends into the second leaf along the pivot axis.

14. The door leaf of claim 13, wherein each of the first pivot plate and the second pivot plate sits substantially flush with the door leaf.

15. The door leaf of claim 11, wherein the hinge is connected to the door frame.

16. The door leaf of claim 1, wherein the first leaf abuts and sits flush with the second leaf in the substantially coplanar arrangement.

17. A door set comprising a door frame and a door leaf, the door leaf comprising:

a first leaf;

a second leaf, wherein the first leaf is connected to the second leaf pivotally about a pivot axis that extends through one of the first leaf and the second leaf;

a lock configured, when in a locked position, to project across an interface between the first leaf and the second leaf to thereby lock the first leaf and the second leaf in a substantially coplanar arrangement, wherein the pivot axis is substantially parallel to and spaced from the interface, wherein the pivot axis and the interface are each positioned closer to a first edge of the door leaf than to a second opposite edge of the door leaf, wherein the entire interface defines a straight line; and a hinge along the first edge of the door leaf and connected to the first leaf, wherein the hinge is connected to the door frame.

18. The door set of claim 17, wherein the hinge comprises a hinge axis substantially parallel with the interface.

19. The door set of claim 17, wherein the first leaf abuts and sits flush with the second leaf in the substantially coplanar arrangement.

20. The door set of claim 17, wherein the pivot axis extends through the second leaf.

* * * * *